US005140818A

United States Patent [19]

Silvestri, Jr. et al.

[11] Patent Number: 5,140,818

[45] Date of Patent: Aug. 25, 1992

[54] INTERNAL MOISTURE SEPARATION CYCLE

[75] Inventors: George J. Silvestri, Jr., Winter Park; Paul W. Viscovich, Longwood, both of Fla.

[73] Assignee: Westinghouse Electric Corp., Pittsburgh, Pa.

[21] Appl. No.: 697,373

[22] Filed: May 9, 1991

[51] Int. Cl.[5] ..... F01K 7/16

[52] U.S. Cl. ..... 60/678; 60/679

[58] Field of Search ..... 60/678, 679, 677

[56] References Cited

U.S. PATENT DOCUMENTS 3,289,408 12/1966 Silvestri, Jr. ..... 60/678

4,069,674 1/1978 Warren ..... 60/678 X 4,825,657 5/1989 Silvestri, Jr. et al. ..... 60/678

4,955,200 9/1990 Viscovich et al. ..... 60/677

*Primary Examiner*—Allen M. Ostrager

[57] ABSTRACT

A steam turbine system including a low pressure (LP) turbine has a plurality of moisture extraction points at which a steam-water mixture is extracted and passed through a respective one of a corresponding plurality of heat exchangers. Each exchanger passes the steam-water mixture in heat exchange relationship with feedwater in a feedwater conduit. A low pressure and low temperature final stage extraction point on the steam turbine is coupled to a condenser, and water collected at the condenser is directed into the feedwater conduit. The system separates at least some of the steam in the steam-water mixture from the final stage extraction point and passes this steam in heat exchange relationship with water in the feedwater conduit.

4 Claims, 2 Drawing Sheets

INTERNAL MOISTURE SEPARATION CYCLE

The present invention relates to steam turbines and, more particularly, to a method and apparatus for improving turbine efficiency by utilization of steam extracted from a final moisture removal stage by a feedwater heater and by controlling the amount of extracted steam.

BACKGROUND OF THE INVENTION

Steam turbine power plants are routinely designed with moisture removal apparatus for extraction of water entrained in the steam flowing through the turbine or collecting on various surfaces within the turbine. Such moisture is desirably removed in order to minimize blade erosion caused by hot water droplets impinging in the blades and further to abate diminution of turbine efficiency from water within the steam flow. In most instances, removal of such water is enhanced by bleeding some steam from the turbine to thereby transport the accumulated moisture. Such extracted steam contains a significant amount of heat energy and utilization of the energy in the extracted steam-water mixture in feedwater heaters to raise the temperature of condensate being returned to a boiler for conversion to steam. One example of a system for using the extracted steam is shown and described in U.S. Pat. No. 3,289,408 assigned to the assignee of the present invention.

U.S. patent application Ser. No. 07/609,938 filed Nov. 7, 1990 and assigned to the assignee of the present invention describes certain attributes of steam turbine systems employing moisture separator reheaters. As pointed out in that application, rising fuel costs have led to the use of higher initial operating pressures and temperatures and additional reheat features, including an increase in the number of heaters that are employed in a turbine cycle. The higher pressures and temperatures have led to other design developments including provision for higher outlet water temperatures by utilizing superheat of the steam, and drain cooling sections in the heaters that subcool condensate. In some prior applications of steam-to-steam reheater drains, drain fluid is discharged as a mixture of condensed steam and scavenging steam from a high pressure reheater in a moisture-separator-reheater (hereinafter MSR) to the highest pressure feedwater heater where the fluid is combined with steam from a first turbine extraction point. From the highest pressure feedwater heater, the condensed steam and other drain flows are then discharged or cascaded seriatim to lower and lower pressure feedwater heaters until at some point in the cycle, the flows become part of the main feedwater stream.

As previously disclosed in U.S. Pat. No. 4,825,657 assigned to Westinghouse Electric Corporation, the drains leaving the MSR high pressure reheater are considerably hotter than the feedwater leaving the highest pressure feedwater heater, as much as 55° C. (100° F.) at rated load, and in excess of 140° C. (250° F.) at 25% load. Accordingly, the drains must be throttled down to the feedwater pressure prior to heat exchange. This results in a loss in thermal efficiency.

One suggested method of minimizing this loss is to pump the high pressure reheater drain fluid into the outlet of the highest pressure feedwater heater. Major drawbacks of this method are: a) an additional pump is required; b) the difficulty of avoiding cavitation due either to insufficient net positive suction head in steady state conditions or to flashing during transients; and c) disposal of scavenging steam that is used to enhance the reheater tube bundle reliability.

The above-referenced U.S. Pat. No. 4,825,657 describes a method and apparatus for improving the thermal efficiency of steam-to-steam reheating systems within steam turbine generator systems by allowing the reheater drain fluid to be directly added to the feedwater stream without the need for additional pumping through use of a drain cooler. The high pressure reheater drain fluid passes through the drain cooler in heat exchange relationship with condensate from the discharge of the highest pressure feedwater heater. This avoids the loss of thermal efficiency resulting from throttling of the reheater drain pressure. Heat rate improvement is greater when the system is operated at less than 100% load. The disclosed system is set forth in the context of field retrofit application to single and multistage moisture-separator-reheaters. These existing systems include drain receivers with level controls. Fluid from high pressure reheater drains is collected in the drain receivers and then directed to a heat exchanger (drain cooler) in heat exchange relationship with condensate from a high pressure feedwater heater. The use of a drain cooler avoids loss of thermal efficiency from throttling of reheater drain pressure.

Conventional reheater drain systems customarily employ a pressure breakdown section between the MSR reheater drain connection and the feedwater heater receiving the drain fluid, and a level-controlled drain receiver to accept the condensed heating steam. There is a significant reliability problem with drain receivers, which frequently produces internal flooding in the tube bundle from the high pressure MSR. Such flooding has contributed to numerous damaged tube bundles, necessitating reduced load operation at impaired plant efficiency.

Further, because of the decrease in heater pressure at low loads, accompanied in many instances with an increase in reheater supply pressure, the percentage of scavenging steam increases with decreasing load. However, an increase in scavenging steam has been shown to have only a small effect on the heat rate of a cycle employing a drain cooler.

U.S. Pat. No. 4,955,200 issued Sep. 11, 1990 discloses a method and apparatus for improving a steam-to-steam reheat system in a steam turbine employing a drain cooler. The utility of a drain cooler is enhanced by installing a condensate bypass line with a control valve to allow adjustment of the condensing capability of the drain cooler by optimizing the amount of scavenging steam in accordance with load conditions, thereby achieving a heat rate reduction. A steam turbine generator employs a steam-to-steam reheating system which utilizes a small component of scavenging steam to prevent moisture build-up in the bottom most tubes of a reheater bundle. The system has a high pressure moisture-separator-reheater with a reheater drain, and several increasingly high pressure feedwater heaters connected in series to heat feedwater. Each of the feedwater heaters has an inlet and an outlet for feedwater. Heating of feedwater is accomplished in a drain cooler which receives fluid from the reheater drain and passes it in heat exchange relationship with outlet feedwater prior to feeding the reheater drain fluid to the highest pressure feedwater heater. The system controls the amount of scavenging steam and the fluid level at the drain cooler heat exchanger to control the heat capacity of the drain cooler and eliminate the need for a drain receiver level control.

Heretofore, it has been general practice to remove accumulated moisture in a low pressure (LP) turbine immediately before the turbine exhaust. As discussed above, such moisture extraction also necessitates some steam extraction. In this final extraction stage, the steam-water mixture is drained to a condenser where the heat in the steam becomes wasted energy. The steam component of this steamwater mass represents not only most of the volume of the mass but also as much as 95% of the total heat energy in the mass. Therefore, the extracted steam is the primary component of the heat energy wasted during this extraction.

A secondary problem occurs in sizing the passages for extracting the steam-water mass at the LP turbine final stage because of the instability of the steam-water mixture and non-equilibrium effects. Heat loss factors such as those from specific piping shapes and internal contours and other factors such as the entrainment rate in the steam and variations in pressure ratio with load changes cannot be precisely known. Moreover, large differences, as much as 40-60%, exist among results based upon accepted models of turbines. Due to such differences, it is common to oversize the passages thereby extracting more steam than necessary and wasting more energy.

The process of improving efficiency in steam turbines is one of attempting to balance optimal thermodynamic characteristics against practicalities of cost. For example, there is an optimal feedwater temperature before the feedwater is returned to the boiler which is lower than the saturation temperature corresponding to the boiler pressure. However, to reach that saturation temperature, the feedwater would have to be passed in heat exchange relationship with extracted steam from the boiler. Such treatment is inefficient since the extracted steam would not have done any work before extraction. Thus, there is a thermodynamic cycle optimum feedwater temperature which, for cost reasons, is generally not met. However, if steam is extracted in order to remove moisture, the loss of efficiency due to steam extraction is compensated by the gain in efficiency in removing moisture.

At most extraction points, there is a significant amount of heat energy in the extracted steam. This energy is partly recaptured by passing the steam in heat exchange relationship with feedwater. As the extraction points move nearer the turbine exhaust, and particularly nearer the exhaust of an LP turbine, the amount of heat energy decreases. The last stage extraction point is at such pressure and temperature that it is common practice to simply dump the extracted steam-water mixture into the system condenser, thereby giving up any remaining heat energy in the extracted steam. As discussed above, there are numerous factors which cause wide variations in the amount of steam extracted at this last stage. Various solutions to this last stage extraction variation problem have been proposed including changing the size of upstream extraction passages and their associated feedwater heaters. Analysis of this type of approach have shown it to be less efficient. Applicants have analyzed the energy in the last stage extraction and believe that an additional increment of heat energy can be recovered from the extracted steam-water mixture by using the steam for feedwater heating. Furthermore, the inefficiencies inherent in oversizing the extraction passages can be compensated by controlling the characteristics of the heat exchanger without changing the passages. Still further, Applicants have found that contrary to present systems, an increase in the amount of steam extracted results in a net efficiency improvement. More particularly, at higher temperature steam extraction points such as those associated with lines 22, 24, or 36 of FIG. 1, an increase in extracted steam results in a net efficiency decrease. Thus, it has not been believed beneficial to utilize heat exchangers at the inlet to the last stage of an LP turbine.

Accordingly, LP turbine final stage extraction has disadvantages both in substantial heat energy waste during moisture removal, where extraction steam is drained to the condenser and in inherent design uncertainties in sizing extraction passages.

SUMMARY OF THE INVENTION

It is an object of the present invention to provide a method and apparatus for overcoming the above and other disadvantages of the prior art and it is a more specific object to provide a method and apparatus for recovering waste energy from extracted steam in a final stage LP turbine and to avoid inefficiencies inherent in oversizing steam extraction passages.

The above and other objects will become apparent from the description to follow. In general, the present invention reclaims the heat energy removed during steam extraction at a last extraction point before steam flow is exhausted from the LP turbine. In an illustrative form, a heat exchanger is added to the system whereby the heat energy in the extracted steam is passed in heat exchange relationship with feedwater from the condenser so as to transfer the heat energy to the feedwater. The added heat exchanger is sized to control the amount of steam extracted from the last extraction point and thereby controls the amount of heat energy removed. A bypass loop controlled by adjacent feedwater temperature sensors allows the amount of extracted steam to be more precisely controlled. By using the extracted steam in a heat exchanger, any oversizing of the steam extraction passages results in a net benefit rather than a loss in efficiency.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
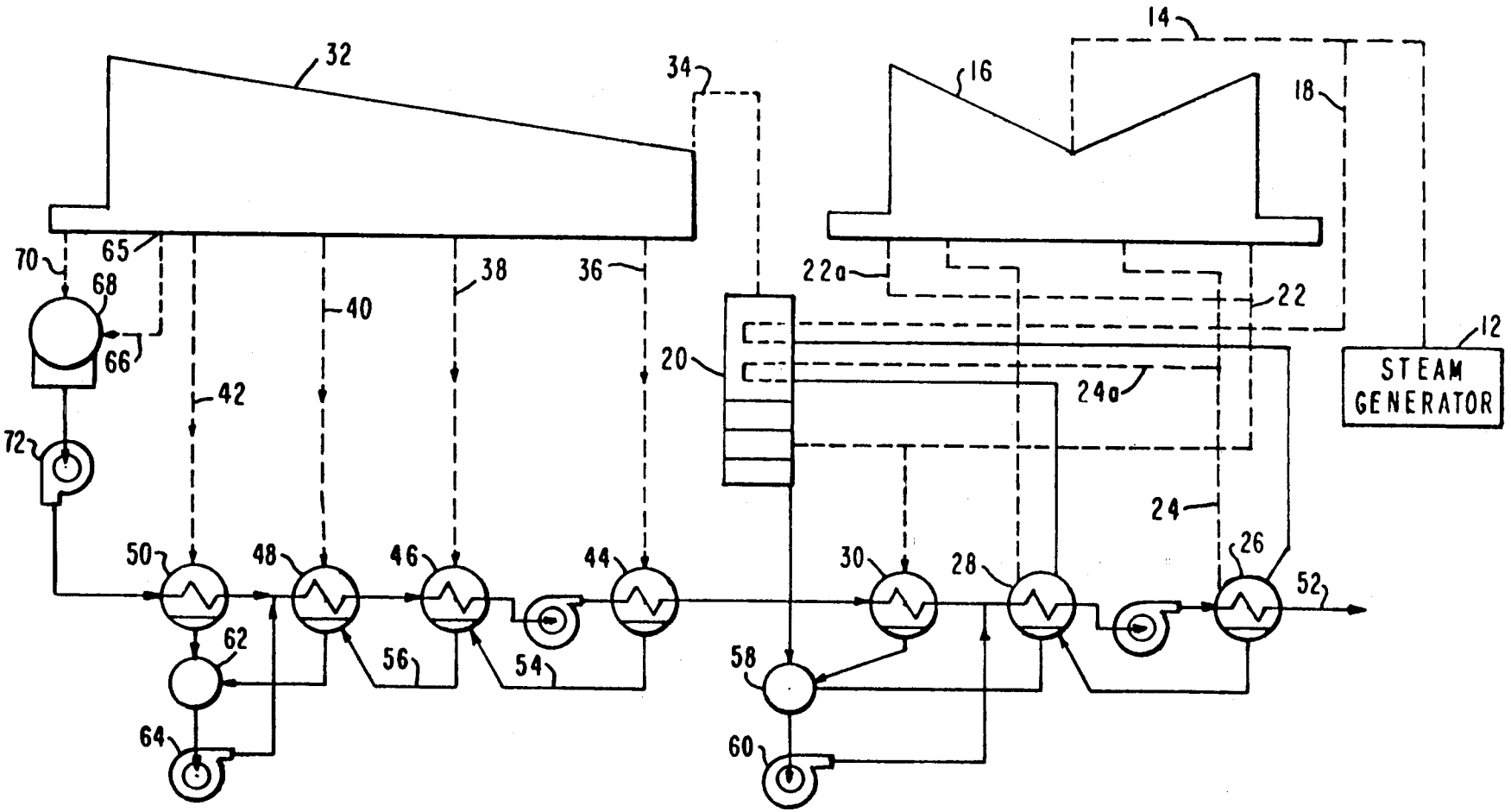
FIG. 1 (PRIOR ART)
FIG. 1 is a simplified schematic of a steam cycle in a prior art HP/LP turbine system.

Referring to FIG. 1, there is shown a simplified schematic of a steam cycle in a typical high pressure/low pressure (HP/LP) steam turbine system 10. A steam generator 12 converts water to steam which is then coupled through line 14 to a steam inlet on HP turbine 16. Some steam in line 14 may be coupled via line 18 to a moisture-separator-reheater (MSR) 20. At several points, moisture is extracted from turbine 16 along with some portion of steam necessary to remove the moisture. Some of the extracted mixtures are coupled via lines 22, **22*a*, 24, and 24*a* into the MSR 20. Other portions of the mixtures are coupled to feedwater heaters 26, 28, and 30. Feedwater passing through the feedwater heaters is brought to successively higher temperatures before returning to the steam generator 12**.

Following moisture removal in the separator section of the MSR 20, the steam fraction is heated to sufficient steam temperatures to be useful in powering LP turbine 32. Steam is coupled from MSR 20 to turbine 32 via line 34. Within turbine 32 there are multiple points at which moisture is extracted along with some steam. In the illustration, lines 36, 38, 40, and 42 couple a steam-water mixture into respective feedwater heat exchangers 44, 46, 48, and 50. In each of the feedwater heaters or heat exchangers, the incoming steam-water mixture condenses into water as heat is extracted to heat the feedwater pumped through conduit 52. This condensate is forced downstream to lower temperature exchangers by the higher pressure of incoming steam. The lines 54, 56 are typical lines for coupling water downstream. At some point in both the LP and HP systems, the available heat energy has been extracted from the steam and the resultant condensate is accumulated and added to the feedwater stream. In the HP system, water from MSR 20 and heat exchangers 26, 28, and 30 is accumulated at tank 58 and pumped via pump 60 into conduit 52. In the LP system, water accumulates in tank 62 and is pumped via pump 64 into conduit 52.

At the inlet to the last stage of turbine 32, the steam-water mixture is nearly at exhaust temperature and a portion of the moisture and its motive steam is generally coupled via line 66 into a condenser 68. The turbine exhaust steam is also directed into condenser 68 via line 70. Water accumulation in condenser 68 is pumped into conduit 52 via pump 72.

As explained above, it has not been the practice to attempt to extract heat energy from the steam-water mixture at the inlet to the last stage of an LP turbine. Applicants have discovered that not only can some heat energy be obtained from this mixture, but that a heat exchanger of specific construction can be used to control the amount of steam extracted, thus compensating for the oversize piping used at this stage. Furthermore, Applicants have found that excess steam extraction, rather than being a detriment as it would be in the system of FIG. 1, can actually produce an improvement in turbine efficiency.

Figure 2:
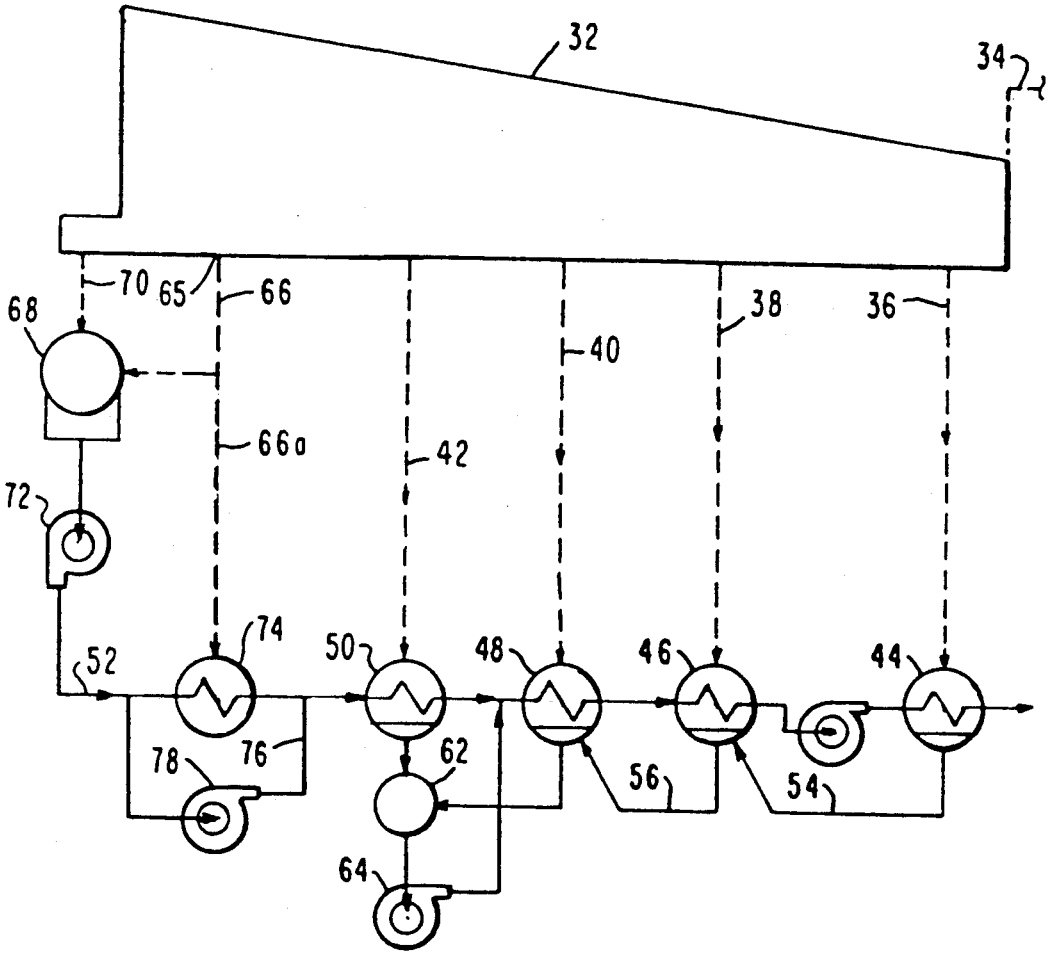
FIG. 2 is a simplified schematic of a portion of FIG. 1 incorporating the present invention.

Turning to FIG. 2, there is shown a partial view of the system of FIG. 1 in which the moisture removal zone 65 of the final LP stage is coupled via line **66*a* to an additional heat exchanger 74. Exchanger 74 utilizes heat energy in steam from line 66 as a first stage heater for feedwater in conduit 52. In addition to heat exchanger 74, the inventive system incorporates a bypass loop 76 including a feed-forward pump 78 which bypasses feedwater around exchanger 74 and thereby controls the capacity of exchanger 74. As more water bypasses exchanger 74, its capacity for condensing steam decreases thereby reducing the volume of extracted steam at the last stage extraction. Control mechanisms for regulating pump 78** in response to temperature or any other selected variable are well known in the art and not discussed herein.

If additional steam is extracted at line 66, the energy of such steam can be used to heat feedwater in conduit 52 and thereby improve the overall system efficiency. Table I is a comparison of the energy reclaimed using the system of FIG. 2 in kilojoules per kilowatt hour (Kj/Kwh) for a system with a standard volume of steam extraction versus doubling of the extracted steam volume.

TABLE I

| | HEAT RATE CHANGE KJ/KWH | | |
|---|---|---|---|
| | 1 CURRENT PRACTICE | 2 IMPROVED CYCLE (Kj/Kwh) | 3 Δ Kj/Kwh (IMPROVEMENT) |
| STANDARD SCAVENGING STEAM: | | | |
| RATED MWT (NSSS) | 0 | −10.5 | 10.5 |
| 90% RATED LOAD | 0 | −10.5 | 10.5 |
| 85% RATED LOAD | 0 | −10.5 | 10.5 |
| 70% RATED LOAD | 0 | −10.5 | 10.5 |
| 65% RATED LOAD | 0 | −10.5 | 10.5 |
| DOUBLE SCAVENGING STEAM: | | | |
| RATED MWT (NSSS) | 5.3 | −15.8 | 21.1 |
| 90% RATED LOAD | 5.3 | −15.8 | 21.1 |
| 85% RATED LOAD | 4.2 | −15.8 | 20.0 |
| 70% RATED LOAD | 4.2 | −15.8 | 20.0 |
| 65% RATED LOAD | 4.2 | −15.8 | 20.0 |

Column 1 (Current Practice) represents the prior art system of FIG. 1. In the standard extraction, assuming ¾ of 1% of available steam is extracted, the system shows a net improvement of 10.5 Kj/Kwh for all loads. If 1.5% of the available steam is extracted, the system of FIG. 1 would have a net cycle loss of between 4.2 and 5.3 Kj/Kwh. However, Applicants' improved system of FIG. 2 shows an improvement over FIG. 1 of between 20 and 21.1 Kj/Kwh, representing a turbine lifetime savings in excess of a million dollars per turbine.

While heat exchangers are used at various higher pressure, higher temperature moisture removal points, the operation of such heat exchangers is different than that of the present invention. As stated above, Applicant have discovered that an increase in the volume of steam-water mixture removed at the final stage moisture removal zone is directly proportional to the efficiency gain within normal limits of the volume to be removed, e.g., between 0.75% and 1.5% of the total volume of steam in the system. At higher pressure, higher temperature stages, an increase in volume of removed steam reduces efficiency. Furthermore, the volume of steam removed at the final stage and the operation of the heat exchanger tends to be self-regulating with load changes, perhaps because the nearby condenser maintains substantially constant pressure/temperature conditions. At the higher pressure, higher temperature heat exchangers, such self-regulation does not occur and sizing of these exchangers is more critical, typically requiring a compromise sizing at 50% of turbine load. Also, at these higher temperature exchangers, some minimum volume of scavenging steam is required to prevent moisture accumulation in the MSR's. Given these typical characteristics of heat exchangers in general use in the steam turbine art, it has not been believed useful to attempt to use a heat exchanger at the final stage moisture removal zone.

While the invention has been described in what is considered to be a preferred embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the appended claims.

What is claimed is:

1. A method for improving efficiency in a steam turbine system having a low pressure (LP) turbine in which a mixture of moisture and motive steam from a final stage moisture removal zone are coupled to a turbine exhaust condenser, water collected at the condenser being coupled through a feedwater conduit to a steam generator, the method including the step of passing part of the removed moisture and motive steam in heat exchange relationship with water in the feedwater conduit to thereby recover at least some of the heat energy in the steam-moisture mixture.

2. The method of claim 1 wherein the system includes a heat exchanger in the feedwater conduit for receiving the steam-moisture mixture and a bypass loop for bypassing feedwater around the heat exchanger, further including the step of selectively bypassing at least some of the feedwater around the heat exchanger for regulating the volume of steam-moisture mixture removed at the final stage moisture removal zone in response to selected system variables.

3. A steam turbine system including a low pressure (LP) turbine having a plurality of moisture extraction points at which a steam-water mixture is extracted and passed through a respective one of a corresponding plurality of heat exchangers, each exchanger passing the steam-water mixture in heat exchange relationship with feedwater in a feedwater conduit, a low pressure and low temperature final stage moisture removal zone on the steam turbine being coupled to a condenser, water collected at the condenser being directed into the feedwater conduit, the system including means for passing part of the steam-water mixture from the final stage moisture removal zone in heat exchange relationship with water in the feedwater conduit.

4. The system of claim 3 wherein the means for passing the steam-water mixture from the final stage moisture removal zone in heat exchange relationship comprises a heat exchanger, the system further including a bypass loop for selectively bypassing feedwater about the heat exchanger to thereby control the volume of steam-water mixture at the final stage removal zone.

* * * * *